United States Patent [19]

Halsey, Jr. et al.

[11] Patent Number: 5,010,701

[45] Date of Patent: Apr. 30, 1991

[54] CORNER SYSTEM FOR LOG CABIN SIDING

[75] Inventors: Brenton S. Halsey, Jr., Richmond, Va.; Arthur C. Larson, Brewer, Me.

[73] Assignee: Diamond Occidental Forest, Inc., Old Town, Me.

[21] Appl. No.: 446,328

[22] Filed: Dec. 5, 1989

[51] Int. Cl.[5] ..... E04B 1/10

[52] U.S. Cl. ..... 52/233

[58] Field of Search ..... 52/233; 446/106

[56] References Cited

U.S. PATENT DOCUMENTS

| | | | |
|---|---|---|---|
| 1,996,735 | 4/1935 | King . | |
| 2,005,921 | 6/1935 | Reither . | |
| 4,096,674 | 6/1978 | Koller et al. . | |
| 4,320,610 | 3/1982 | Rupp . | |
| 4,330,973 | 5/1982 | Marklund | 52/233 |
| 4,429,500 | 2/1984 | Farmont . | |
| 4,503,647 | 3/1985 | Post . | |
| 4,592,182 | 6/1986 | Felser . | |
| 4,627,204 | 12/1986 | Smith . | |
| 4,640,069 | 2/1987 | Felser . | |
| 4,878,328 | 11/1989 | Berge | 52/233 |

*Primary Examiner*—John E. Murtagh

*Attorney, Agent, or Firm*—Daniel H. Kane

[57] ABSTRACT

A corner system for log cabin siding construction over building frame walls and corners gives the appearance of full log construction. Elongate wall siding pieces are applied over the walls with a flat inner side facing the wall and a curved outer side for simulated "log" appearance. Corner siding pieces are applied over the corners with wall covering portions in horizontal alignment with wall siding pieces, and projecting log end portions extend beyond the building corner. Each corner siding piece is cut from a single piece of wood without a joint or seam and with continuous grain between the wall covering portion and the projecting log end portion of a corner siding piece. Wall siding pieces and corner siding pieces are formed with edge configuration of overlapping "ship-lap" siding or interfitting tongue and groove siding.

8 Claims, 2 Drawing Sheets

CORNER SYSTEM FOR LOG CABIN SIDING

TECHNICAL FIELD

This invention relates to a new corner system for log cabin siding constructed over a conventional building frame to give the appearance of whole log construction. The invention provides improved appearance at the corners without artificial joints or seams and with continuity of grain between wall covering portions and log end projections of corner siding pieces.

BACKGROUND ART

In conventional building construction with log cabin siding, elongate siding pieces are formed with a flat inner face for covering the walls of the building frame, and a rounded or curved surface on the outer face to simulate the log cabin appearance. Such simulated log cabin siding is used over stud frame buildings, post & beam frames, and other conventional framing systems. An aesthetic problem with log cabin siding is that the elongate fractional simulated "logs" or slabs do not give the appearance of authentic log construction at the corners where the fractional "log" siding pieces terminate. As a result a variety of cornering systems, simulated log cabin corner units, and "false tenon" structures have been devised to present the appearance of full log cabin construction for simulated log cabins, log houses, and log cabin siding construction generally. The prior art references of which applicants are aware were found in a search, conducted in the U.S. Patent and Trademark Office Class/Subclass 52/233.

According to one approach described for example in U.S. Pat. Nos. 4,627,204 (Smith) and 4,320,610 (Rupp), simulated log end pieces or full log end pieces are arranged in a vertical column and secured to the corner of the building to simulate full log corner joints. Similarly in U.S. Pat. Nos. 4,096,674 (Koller et al.) and 2,005,921 (Reither) false mortise and tenon structures may be secured to a building corner to present the appearance of full log structures.

According to another arrangement set forth in the Felser U.S. Pat. Nos. 4,592,182 and 4,640,069, the simulated log cabin siding pieces alternately extend beyond the building corner. Elongate blocks are secured to the siding pieces or slabs where they project beyond the corner to give the appearance of full log construction. A disadvantage of this construction arrangement is that extra labor is required and a visible joint or seam remains in the log end projections without continuity of the grain. In the King U.S. Pat. No. 1,996,735, thin or narrow blocks are secured to ends of the siding pieces.

In U.S. Pat. No. 4,330,973 Marklund et al. describe a more conventional log cabin construction with self supporting half round logs terminating in full round ends. In this respect Marklund et al. do not address the particular problems of log cabin siding construction over conventional frame buildings. Other examples of conventional log cabin construction are found in the Farmont U.S. Pat. No. 4,429,500 and the Post U.S. Pat. No. 4,503,647.

OBJECTS OF THE INVENTION

It is therefore an object of the present invention to provide a new corner system for log cabin siding constructed over conventional type building frames, giving the appearance of full log construction.

Another object of the invention is to provide a corner system for log cabin siding construction without joints or seams in full log end terminations projecting at the corners. A feature of this arrangement is that it provides continuity of grain between the wall covering portions and the full log end projections for corner siding pieces.

A further object of the invention is to provide integral simulated log cabin construction corner siding pieces each cut from a single piece of wood for production and assembly with reduced labor and for improved appearance.

DISCLOSURE OF THE INVENTION

In order to accomplish these results, the invention provides a log cabin siding corner system for application over a frame building corner of first and second walls covered with wall sheathing material intersecting substantially at right angles. Elongate wall siding pieces cover the walls with a flat inner side facing the wall and a curved outer side for simulated log cabin appearance. The wall siding pieces are applied in substantial horizontal alignment over the walls and are arranged with top and bottom edges of adjacent wall siding pieces abutting.

According to the invention, elongate corner siding pieces are provided for use on the walls at the building corner. The corner siding pieces have an elongate wall covering portion matching the wall siding pieces and are arranged in horizontal alignment with the wall siding pieces. An elongate projecting log end portion extends beyond the building corner. A feature of the invention is that the projecting log end portion is formed integrally in a single piece with the wall covering portion. That is, each corner siding piece is cut from a single piece of wood without a joint or seam and with continuous grain between the wall covering portion and projecting log end portion.

The projecting log end portion is cut with a thickness substantially greater than the wall covering portion for the simulated whole log appearance at the building corner. An advantage of the log cabin siding corner system of the invention is the improved appearance at the corners. The absence of artificial joints or seams on the corner siding pieces and the continuity of grain more accurately emulates appearance of authentic log cabin construction.

The corner siding pieces on the intersecting walls at the building corner are arranged in vertical sequence with projecting log end portions extending alternately from the first and second walls substantially at right angles to each other. The wall covering portion of each corner siding piece is applied to one of the first or second walls and the projecting log end portion is cut with a flat reverse facing side which abuts against the other wall.

The corner siding pieces are also formed with a flat inset surface on top formed over the length of the projecting log end portion. The flat inset surface on top also extends along a length of the wall covering portion a distance substantially equal to the lateral thickness of the projecting log end portion. The flat inset surface formed on top of one corner siding piece accommodates the projecting log end portion of the next corner siding piece extending at right angles in vertical sequence above. Each corner siding piece on one wall is further arranged with the inner surface of the projecting log end portion abutting the end of a wall siding piece applied in horizontal alignment and at right angles on the other wall.

The log cabin siding corner system according to the invention includes a number of additional features. The edges of the siding pieces may be cut in appropriate configuration for either overlapping ship-lap siding or interfitting tongue and groove siding. Other objects, features and advantages of the inventions are apparent in the following specification and accompanying drawings.

DESCRIPTION OF PREFERRED EXAMPLE EMBODIMENTS AND BEST MODE OF THE INVENTION

Figure 1:
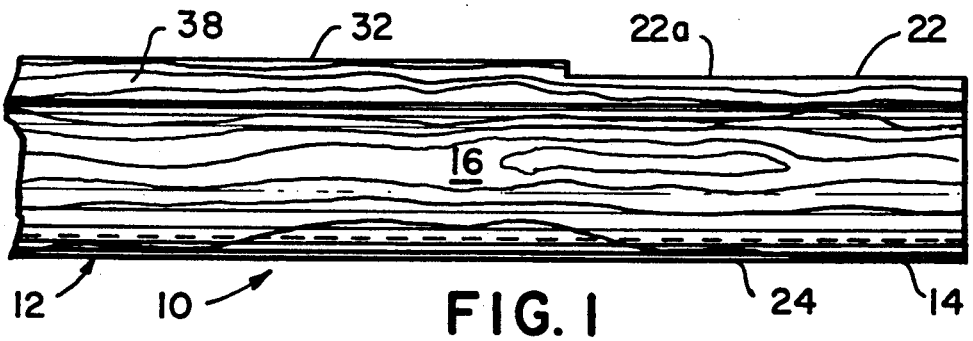
FIG. 1 is a fragmentary side elevation view of a portion of a corner siding piece from the outer side.
Figure 2:
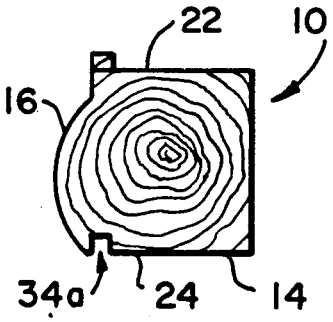
FIG. 2 is an end view of the corner siding piece looking at the projecting log end portion on the right side of FIG. 1.
Figure 3:
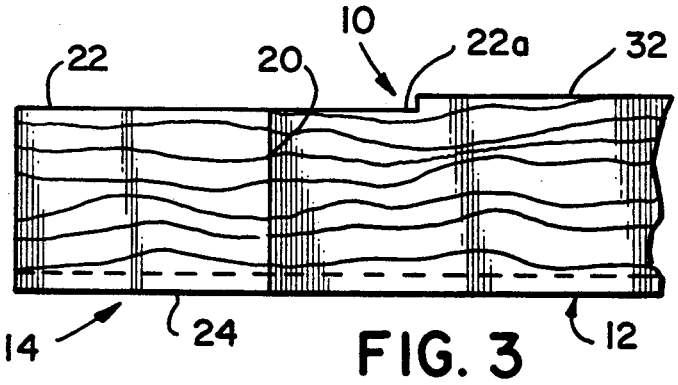
FIG. 3 is a fragmentary side elevation view of a portion of the corner siding piece from the inner side with the ends reversed from FIG. 1 so that the projecting log end portion is on the left of FIG. 3.
Figure 4:
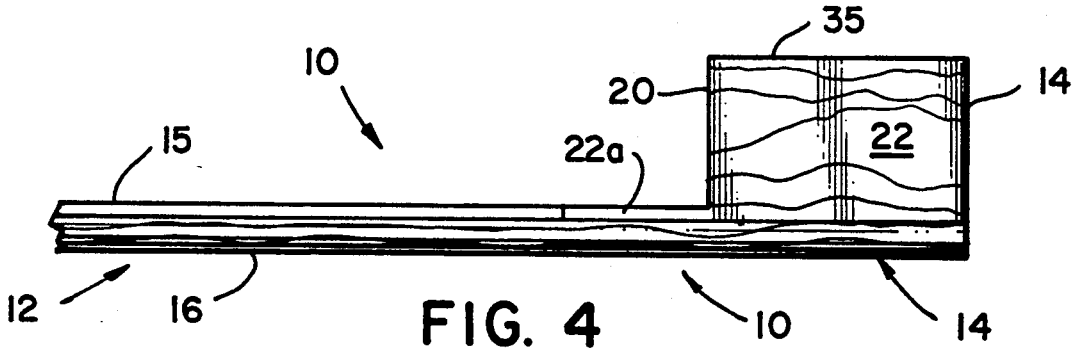
FIG. 4 is a plan view from above of the corner siding piece of FIG. 1.

A corner siding piece 10 according to the invention is illustrated in FIGS. 1–4. The corner piece 10 is formed with an elongate wall covering portion 12 and a relatively thicker elongate projecting log end portion 14. The corner siding wall covering portion 12 is cut with a flat inner side 15 for application on a building wall, and a curved outer side 16 for simulated log cabin appearance.

Figure 7:
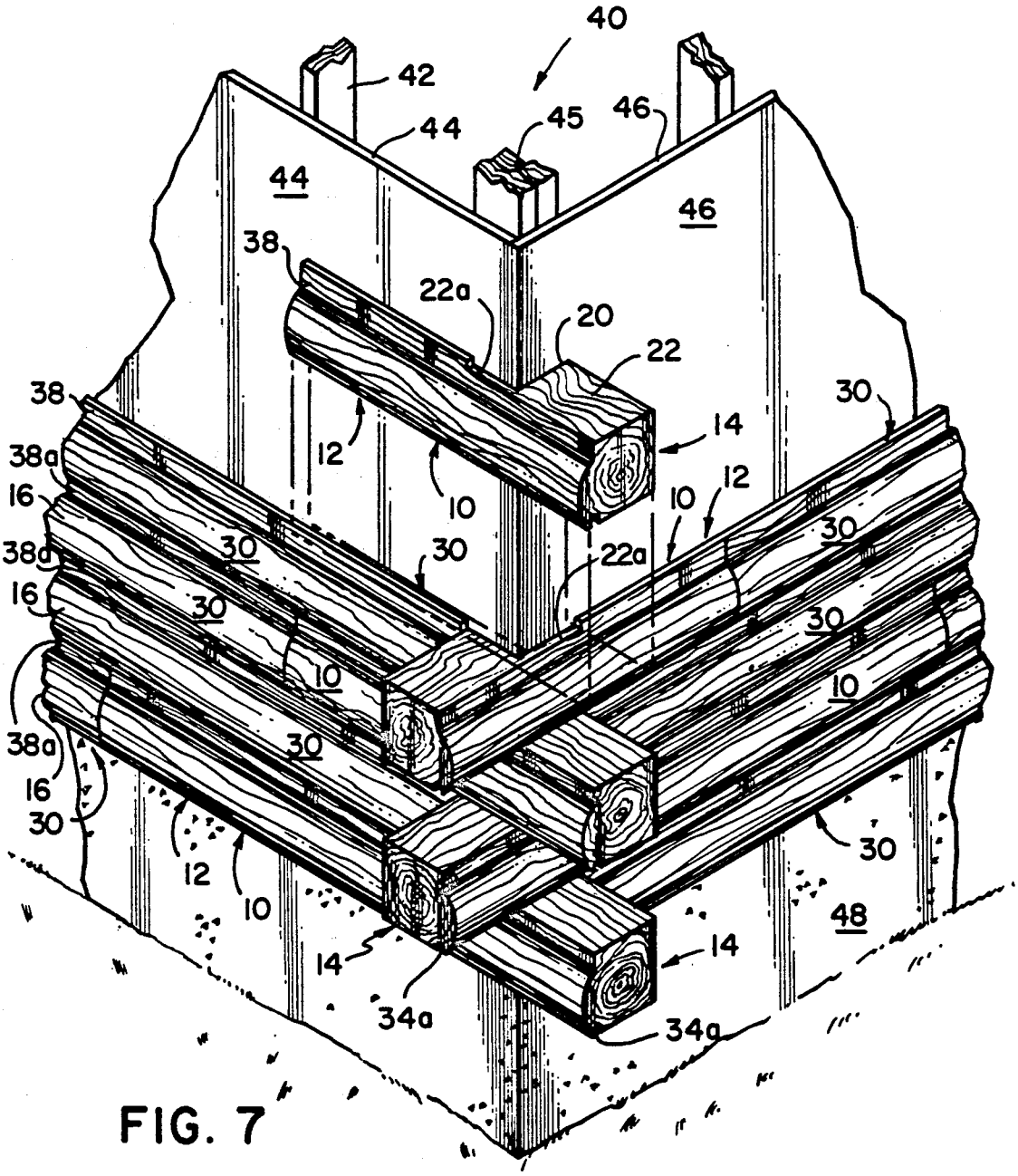
FIG. 7 is a fragmentary or partial perspective view at the corner of a conventional building frame on a foundation, with sheathing material covering the walls and showing the application of the log cabin siding corner system of the present invention.

The projecting log end portion 14 is formed as an integral extension from the wall covering portion and the entire corner siding piece 10 is cut from a single piece of wood without a joint or seam. As a result there is continuity of the grain between the wall covering portion and projecting log end portion for the appearance of authentic log cabin construction as illustrated in FIG. 7.

The projecting log end portion 14 is formed with a flat reverse facing side 20. While the inner face 15 of the wall covering portion 12 of the corner siding piece 10 rests flush against one of the perpendicular intersecting walls at a building corner, the reverse facing side 20 of the projecting log end portion 14 rests flush against the other of the intersecting walls at the building corner. The projecting log end portion 12 is generally formed with flat top and bottom faces 22 and 24 along the length of the projecting log end portions for resting on each other in the vertical sequence as hereafter described.

The flat top surface 22 is formed as a flat inset surface 22 over the length of the projecting log end portion and along a length 22*a* of the wall covering portion 12. The length 22*a* of the flat inset surface 22 along the wall covering portion 12 extends a distance substantially equal to the lateral thickness of the projecting log end portion. The flat inset surface length 22*a* therefore accommodates the projecting log end portion of the next corner siding piece extending at right angles in vertical sequence above so that the projecting log end portions of the sequential corner siding pieces rest on each other as illustrated in FIG. 7.

Figure 5:
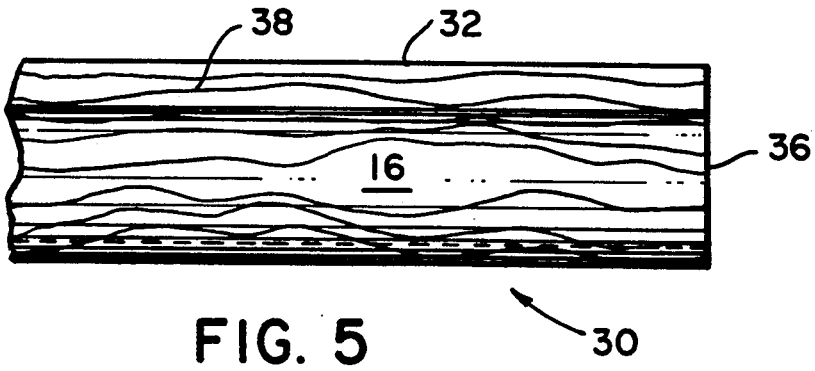
FIG. 5 is a fragmentary side elevation view of a wall siding piece. It also illustrates the wall covering portion of the corner siding piece at the end opposite the projecting log end portion.
Figure 6:
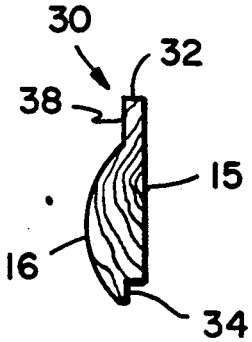
FIG. 6 is an end view of the wall siding piece, and also the wall covering portion of the corner siding piece, showing the top and bottom edges in the configuration for complementary overlapping ship-lap log cabin siding.

A straight wall siding piece 30 is illustrated in FIGS. 5 and 6. FIGS. 5 and 6 may also be viewed as illustrating a wall covering portion end of a corner siding piece. The wall siding piece 30 is also formed with a flat inner face or side 15 for application over the building wall and a curved outer side 16 which provides the simulated log cabin appearance. Generally the wall siding pieces 30 match the wall covering portion 12 of the corner siding pieces 10 for horizontal alignment of abutting ends over the walls of the building as illustrated in FIG. 7.

The wall siding pieces 30 and the wall covering portion 12 of the corner siding pieces 10, in the example of FIGS. 1–7 are formed with top and bottom edges 32 and 34 with complementary overlapping ship-lap configuration. Thus the bottom edge 34 of an upper siding piece is cut with a notch which overlaps the top edge 32 of the next siding piece below, a specified overlap distance. The inset surface 22 and its extension 22*a* are inset a depth distance equal to the overlap distance of the ship-lap edges so that the projecting log end portions extending at right angles in vertical sequence rest upon each other as heretofore described.

In the ship-lap log cabin siding configuration example of FIGS. 1–7, it is noted that the wall siding pieces 30 and the wall covering portions 12 of the corner siding pieces 10 are formed with a curved outer side or outer face 16 terminating in a flat trim 38 which in turn terminates in the top edge 32. The flat trim 38 is wider than the overlap distance of the top and bottom ship-lap edges 32,34 leaving a flat spacing 38*a* between the curved outer sides 16 of the siding pieces as illustrated in FIG. 7. This gives the appearance of the traditional "chinking" or filling between full size logs.

Another construction feature of the example of FIGS. 1–7 is that the projecting log end portion 14 of a corner siding piece 10 is formed with a flat inner face 35 for abutting against the flat terminating end 36 of a wall siding piece 30. The abutting wall siding piece is in horizontal alignment with, and at right angles to, the corner siding piece adjacent to a building corner.

Assembly of the corner system for log cabin construction is illustrated in FIG. 7. A portion of a building corner 40 is shown for a conventional stud frame 42 with first and second walls covered with wall sheathing material 44 and 46 intersecting at right angles at the stud frame corner post 45. The building frame rests on foundation 48. Elongate wall siding pieces 30 are applied in horizontal alignment over the walls 44 and 46 with respective top and bottom edges of adjacent wall siding pieces overlapping in ship-lap configuration. The elongate corner siding pieces 10 are applied on the walls at the building corner with elongate wall covering portions 12 matching the wall siding pieces 30 and arranged in horizontal alignment with the wall siding pieces 30. The elongate projecting log end portions 14 extend beyond the building corner.

The corner siding pieces 10 at the building corner are arranged in vertical sequence with projecting log end portions 14 extending alternately from the first and second walls 44,46 substantially at right angles to each other. The flat inset surfaces 22 on top and the flat bottom surfaces 24 of the projecting log end portions 14 permit the projecting log end portions to lie on each other in vertical sequence extending alternately at right angles to each other. The residual notch 34*a* is visible at the end of the projecting log end portion 14 resulting from the overlapping bottom edge 34 required for the ship-lap siding configuration.

Figure 9:
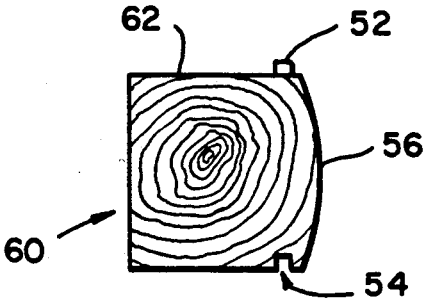
FIG. 9 is an end view of the corner siding piece for tongue and groove log cabin siding looking at the projecting log end portion.
Figure 8:
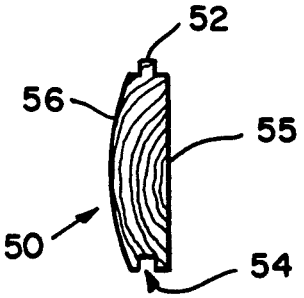
FIG. 8 is an end view of a wall siding piece, and also the wall covering portion of the corner siding piece, showing top and bottom edges in the configuration for complementary interfitting tongue and groove log cabin siding.

An alternate configuration for the top and bottom edges of the siding pieces suitable for interfitting tongue and groove siding is illustrated in FIGS. 8 and 9. In this example a wall siding piece 50 similar to the wall siding piece 30 is formed with a tongue 52 at the top edge and a groove 54 at the bottom edge. FIG. 8 also illustrates the wall covering portion of a corner siding piece. The wall siding piece 50 is similarly formed with a flat inner side 55 for application against the building wall and a curved outer side 56 simulating the log cabin appearance.

The projecting log end portion of a tongue and groove corner siding piece 60 is shown in FIG. 9. The tongue 52 and groove 54 appear at one side of the relatively thicker projecting log end portion adjacent to the curved surface outer side 56. In the case of tongue and groove configuration siding, the flat inset surface 62 on the top of the projecting log end portion is formed by cutting off or terminating the tongue 52 the appropriate distance before the end of the projecting log end portion.

While the invention has been described with reference to particular example embodiments it is intended to cover all modifications and equivalents within the scope of the following claims.

We claim:

1. A corner system for building construction with log cabin siding comprising:

a building corner with first and second walls covered with sheathing material intersecting substantially at right angles;

elongate wall siding pieces applied over the walls, said wall siding pieces having a flat inner side facing the building wall and a curved outer side for simulated log cabin appearance, said wall siding pieces being applied in substantial horizontal alignment over the walls and arranged with top and bottom edges of adjacent wall siding pieces abutting;

elongate corner siding pieces for use on the walls at the building corner, said corner siding pieces having an elongate wall covering portion matching the wall siding pieces and being arranged in horizontal alignment with the wall siding pieces, and an elongate projecting log end portion extending beyond the building corner, said projecting log end portion being formed integrally in a single piece with the wall covering portion, each corner siding piece being cut from a single piece of wood without a joint or seam and with continuous grain between the wall covering portion and projecting log end portion;

said projecting log end portion having a thickness substantially greater than the wall covering portion for simulated whole log appearance at the building corner;

said corner siding pieces on the intersecting walls at the building corner being arranged in vertical sequence at the building corner with projecting log end portions extending alternately from the first and second walls substantially at right angles to each other, each corner siding piece having a wall covering portion applied to one of the first or second walls and a projecting log end portion with a flat reverse facing side abutting against the other wall;

said corner siding pieces being formed with a flat inset surface on top formed over the length of the projecting log end portion and along a length of the wall covering portion a distance substantially equal to the lateral thickness of the projecting log end portion for accommodating the projecting log end portion of the next corner siding piece extending at right angles in vertical sequence above;

each corner siding piece on one wall having the projecting log end portion abutting the end of a wall siding piece applied in horizontal alignment and at right angles on the other wall;

the corner siding pieces being formed with projecting log end portions having flat top and bottom faces along the length of the projecting log end portions, said projecting log end portions resting on each other in vertical sequence;

the projecting log end portion of each corner siding piece on one wall being formed with a flat inner face, the abutting wall siding piece in horizontal alignment at right angles on the other wall being formed with a straight edge at the end for abutting against the flat inner face of the projecting log end portion.

2. The corner system of claim 1 wherein the wall siding pieces and the wall covering portion of corner siding pieces are formed with top and bottom edges having respective complementary overlapping ship-lap configuration for overlapping a specified overlap distance, and wherein the flat inset surface on top of each corner siding piece is inset a distance substantially equal to said overlap distance for accommodating the projecting log end portions extending at right angles in vertical sequence.

3. The corner system of claim 2 wherein the wall siding pieces and wall covering portions of the corner siding pieces are formed with a curved outer side terminating in a flat trim on one side for receiving overlap of the next adjacent siding piece, said flat trim having a width greater than the overlap distance thereby leaving a flat spacing between curved outer sides of adjacent siding pieces.

4. The corner system of claim 1 wherein the wall siding pieces and the wall covering portion of the corner siding pieces are formed with top and bottom edges having respective complementary interfitting tongue and groove configuration.

5. The corner system of claim 4 wherein the flat inset surface on top of each corner siding piece is formed by removing the tongue over the length of the projecting log end portion and along said length of the wall covering portion a distance substantially equal to the lateral thickness of the projecting log end portion.

6. The corner system of claim 1 wherein the elongate wall siding pieces are relatively thin slabs having a thickness at least several times less than the thickness of the projecting log end portions.

7. A corner system for building construction with log cabin siding comprising:

a building corner with first and second walls covered with sheathing material intersecting substantially at right angles;

elongate wall siding pieces applied over the walls, said wall siding pieces having a flat inner side facing the building wall and a curved outer side for simulated log cabin appearance, said wall siding pieces being applied in substantial horizontal alignment over the walls and arranged with top and bottom edges of adjacent wall siding pieces abutting;

elongate corner siding pieces for use on the walls at the building corner, said corner siding pieces having an elongate wall covering portion matching the wall siding pieces and being arranged in horizontal alignment with the wall siding pieces, and an elongate projecting log end portion extending beyond the building corner, said projecting log end portion being formed integrally in a single piece with the wall covering portion, each corner siding piece being cut from a single piece of wood without a joint or seam and with continuous grain between the wall covering portion and projecting log end portion;

said projecting log end portion having a thickness substantially greater than the wall covering portion for simulated whole log appearance at the building corner;

said corner siding pieces on the intersecting walls at the building corner being arranged in vertical sequence at the building corner with projecting log end portions extending alternately from the first and second walls substantially at right angles to each other, each corner siding piece having a wall covering portion applied to one of the first or second walls and a projecting log end portion with a flat reverse facing side abutting against the other wall;

said corner siding pieces being formed with a flat inset surface on top formed over the length of the projecting log end portion and along a length of the wall covering portion a distance substantially equal to the lateral thickness of the projecting log end portion for accommodating the projecting log end portion of the next corner siding piece extending at right angles in vertical sequence above;

each corner siding piece on one wall having the projecting log end portion abutting the end of a wall siding piece applied in horizontal alignment and at right angles on the other wall;

the wall siding pieces and the wall covering portion of corner siding pieces being formed with top and bottom edges having respective complementary overlapping ship-lap configuration for overlapping a specified overlap distance, and wherein the flat inset surface on top of each corner siding piece is inset a distance substantially equal to said overlap distance for accommodating the projecting log end portions extending at right angles in vertical sequence;

the corner siding pieces being formed with projecting log end portions having flat top and bottom faces along the length of the projecting log end portions, said projecting log end portions resting on each other in vertical sequence;

the projecting log end portion of each corner siding piece on one wall being formed with a flat inner face along the length of the log end portion, the abutting wall siding piece in horizontal alignment at right angles on the other wall being formed with a straight edge at the end for abutting against the flat inner face of the projecting log end portion.

8. The corner system of claim 7 wherein the elongate wall siding pieces are relatively thin slabs having a thickness at least several times less than the thickness of the projecting log end portions.

* * * * *